United States Patent [19]

Lee

[11] Patent Number: 4,915,776

[45] Date of Patent: Apr. 10, 1990

[54] PROCESS FOR ETCHING COPPER WITH AMMONIACAL ETCHANT SOLUTION AND RECONDITIONING THE USED ETCHANT SOLUTION

[76] Inventor: Ming H. Lee, No. 16, Lane 25, Lin-Hsi Street, Taipei, Taiwan

[21] Appl. No.: 341,469

[22] Filed: Apr. 21, 1989

[51] Int. Cl.[4] ..... B44C 1/22; C03C 15/00; C03C 25/06; C23F 1/00

[52] U.S. Cl. ..... 156/642; 156/656; 156/666; 252/79.5

[58] Field of Search ..... 156/642, 656, 659.1, 156/666, 345; 252/79.5

[56] References Cited

U.S. PATENT DOCUMENTS 4,233,106 11/1980 Goffredo ..... 156/642 X
4,576,677 3/1986 Faul et al. ..... 156/642

*Primary Examiner*—William A. Powell
*Attorney, Agent, or Firm*—Banner, Birch, McKie & Beckett

[57] ABSTRACT

A process for etching copper with an ammoniacal etchant solution and reconditioning the etchant solution which consumes only feeds of oxygen and water for etching copper and only small amount of pollutant is obtained.

4 Claims, 1 Drawing Sheet

PROCESS FOR ETCHING COPPER WITH AMMONIACAL ETCHANT SOLUTION AND RECONDITIONING THE USED ETCHANT SOLUTION

BACKGROUND OF THE INVENTION

The present invention relates to a process for etching copper with an ammoniacal etchant solution and reconditioning the used etchant solution. According to the process of the present invention, only feeds of oxygen and water are consumed for etching copper and the amount of residual pollutant is significantly minimized.

The etching of copper is carried out for many purposes which include cleaning copper surfaces, providing a desired pattern on the copper surface and providing a conductive image on a copper clad laminate in the production of printed circuit boards.

With the rapid progress of electronic industry, there has been an increasing demand for high quality printed circuit boards in large amount. In the production of printed circuit boards with conductive images on electrically insulative substrates, the etching of cladded copper is critical to the quality of the printed circuit board. Many etchants for this purpose have been developed, of which the ammoniacal etchants are considered most representative. Ammoniacal etchants has high selectivity toward metals (they do not attack gold, nickel, lead or tin and thus are commonly used in the production of double-sided, multilayer or flexible printed circuit boards. To reduce the cost of production and the hazard of residual pollutants, many processes for reconditioning the used etchant solution have been developed. The reconditioning of the used etchant solution provides as least two advantages: (1) recovering valuable copper solute from the etchant, and (2) reducing the consumption of etchant solution. However, the presently known processes, some examples of which are cited below, are still far from being satisfactory and efforts have been taken to find improved process for reconditioning the used etchant solution.

U.S. Pat. No. 4,490,224 and UK Patent No. 2133806 A disclose similar processes in which the copper solute in the used etchant solution is recovered by electroplating the copper ion onto the cathode in an electroplating cell in which a semi-permeable membrane is interposed between the cathode and the anode to keep the copper ion to the side of the anode. These processes suffer from disadvantages including high electricity consumption, low production rate and high initial investment.

U.S. Pat. No. 4,083,758 discloses a process in which the copper solute in the etchant solution is recovered by extracting copper ion from the aqueous phase into an organic solvent phase, transporting the organic solvent phase into a reactor to react the copper ion with an acid (such as sulfuric acid) and then recovering copper by electrolysis. The process is most prominently implemented by Sigma Engineering AB of Sweden. The major disadvantages of the process are (1) the quality of the reconditioned etchant solution is adversely affected by the residual organic solvent in the reconditioned etchant solution, (2) high electricity is required, (3) the initial investments is high, and (4) large area for the installation of the apparatus is required.

U.S. Pat. No. 4,303,704 discloses a process to reduce the copper value in the used etchant solution by ion exchange resin. Ion exchange resin is generally used for extracting copper content in low concentration such as that in rinse water. The concentration of copper in such solution is measured by ppm. However, for used etchant solution in which the concentration of copper ion is generally as high as 100–180 grams per liter, the process is apparently impractical.

U.S. Pat. No. 4,280,887 discloses a process for reconditioning used etchant solution in which aluminium or aluminium ion is used to substitute copper ion in an electrochemical process to form precipitates of $Al(OH)_3$ and Cu. The precipitates are thereafter separated. The process requires the employment of metal aluminium to form the aluminium hydroxide precipitate and therefore has a great disadvantage in that the separation of the coprecipitated copper and aluminium hydroxide is very costly and may result in severe pollution problem.

In view of the above, there has not been any process which can satisfactorily, effectively and economically recondition the used etchant solution of copper.

SUMMARY OF THE INVENTION

It is therefore an object of the present invention to provide a process to satisfactorily recondition used etchant solution for copper with high efficiency and low cost without causing pollution problem.

Accordingly, the present invention in its broadest context encompass a process for etching copper with an etchant solution and reconditioning said etchant solution. The process of the present invention comprises:

providing an etching zone, a first reaction zone, a second reaction zone, a decomposition zone, and a hydration zone, the etching zone containing a charge of the etchant solution and the copper material to be etched, and the etchant solution used for the present invention being an aqueous solution of ammonium hydroxide and ammonium chloride;

supplying to the etching zone a gaseous feed stream comprising oxygen in excess amount;

allowing the etchant solution to undergo etching reaction with the copper content in the etching zone to form an aqueous used etchant solution which contains tetrammine copper chloride;

introducing to the first reaction zone the aqueous used etchant solution and a feed of calcium hydroxide drawn from the hydration zone;

allowing the first aqueous used etchant solution and the calcium hydroxide to react in the first reaction zone to form a first reaction mixture containing ammonia gas, an aqueous calcium chloride solution and copper hydroxide precipitate;

separating the copper hydroxide precipitate from the first reaction mixture;

introducing the ammonia gas and the aqueous calcium chloride solution to the second reaction zone;

supplying to the second reaction zone a first feed water and a feed of carbon dioxide drawn from the decomposition zone;

allowing the first feed water, the carbon dioxide, the ammonia and the aqueous calcium chloride solution to undergo reaction in the second reaction zone at a pH value lower than 7 to form a second reaction mixture of an aqueous solution of ammonium hydroxide and ammonium chloride and calcium carbonate precipitate;

separating the calcium carbonate precipitate from the second reaction mixture and introducing the separated calcium carbonate precipitate into the decomposition zone;

sintering the calcium carbonate precipitate at a sintering temperature above 600° C. to form gaseous carbon dioxide and calcium oxide;

introducing the gaseous carbon dioxide as the feed of carbon dioxide to the second reaction zone;

introducing the calcium oxide to the hydration zone;

supplying a second feed water to the hydration zone;

allowing the calcium oxide to react with the second feed water to form the feed of calcium hydroxide which is introduced into the first reaction zone.

DETAILED DESCRIPTION OF THE INVENTION

Figure 1:
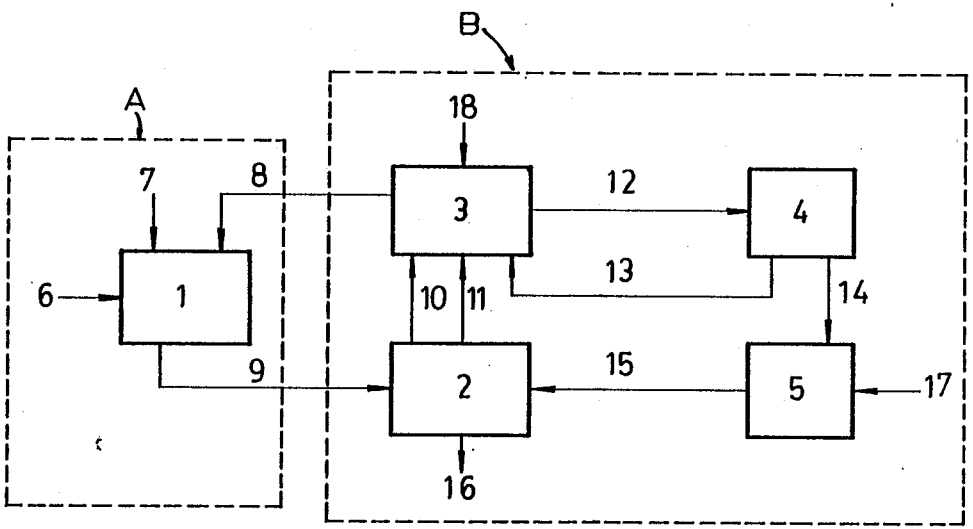
FIG. 1 is a schematic diagram of the process of the present invention.

While this specification concludes with claims particularly pointing out and distinctly claiming that which is considered to be the invention, it is believed that the invention can be better understood from a reading of the following detailed description of the invention and the appended examples.

The reactions between copper and the ammoniacal etchant solution in the process of the present invention may be formulated as follows:

$$\text{(A)}\ Cu + Cu^{++}(NH_3)_4Cl_2 \rightarrow 2Cu^{+}(NH_3)_2Cl$$

$$\text{(B)}\ 2Cu^{+}(NH_3)_2Cl + 2NH_4OH + 2NH_4Cl + \tfrac{1}{2}O_2 \rightarrow 2Cu^{++}(NH_3)_4Cl_2 + 3H_2O$$

The net reaction of (A) and (B) is:

$$\begin{aligned}\text{(C)} &= \text{(A)} + \text{(B)} \\ &= Cu^0 + 2NH_4OH + 2NH_4Cl + \tfrac{1}{2}O_2 \rightarrow Cu(NH_3)Cl_2 + 3H_2O\end{aligned}$$

If the reaction of the following formula:

$$\text{(D)}\ Cu(NH_3)_4Cl_2 + 4H_2O \rightarrow Cu(OH)_2\downarrow + 2NH_4Cl + 2NH_4OH$$

can be established, the net reaction of (C) and (D) will then become:

$$\text{(E)} = \text{(C)} + \text{(D)} = Cu^{\circ} + H_2O + \tfrac{1}{2}O_2 \rightarrow Cu(OH)_2\downarrow$$

The reactants required for etching copper will then be only water and oxygen and the product will be only copper hydroxide. The cost for the etchant agents and the amount of residues will then be greatly reduced.

According to the present invention, the following reaction scheme is devised to establish the net reaction of formula (D) to realize the desired advantages:

Step (1)

$$\text{(F)}\ Cu(NH_3)_4Cl_2 + Ca(OH)_2 \rightarrow Cu(OH)_2\downarrow + CaCl_2 + 4NH_3\uparrow$$

Step (2)

$$\text{(G)}\ CaCl_2 + NH_4HCO_3 + NH_4OH \rightarrow CaCO_3\downarrow + 2NH_4Cl + H_2O$$

(in basic environment, pH>7)

Step (3)

$$\text{(H)}\ CaCO_3 \xrightarrow[\Delta]{900^\circ\ C.} CaO + CO_2\uparrow$$

Step (4)

$$\text{(I)}\ CaO + H_2O \rightarrow Ca(OH)_2$$

$$\text{(J)}\ NH_3 + CO_2 + H_2O \rightarrow NH_4HCO_3$$

$$\text{(K)}\ 3NH_3 + 3H_2O \rightarrow 3NH_4OH$$

Combining reactions (F)-(K), the net reaction:

$$Cu(NH_3)_4Cl_2 + 4H_2O \rightarrow Cu(OH)_2\downarrow + 2NH_4Cl + 2NH_4OH$$

which is identical to the reaction of formula (D) is obtained.

Accordingly, the present invention implements a process which embodies the above reactions. The process of the present invention will be illustrated with the aid of the accompanying drawing.

Referring to the drawing, dashed square A covers the etching process of copper which is carried out within the etching machine 1. The reaction within etching machine 1 is a conventional reaction which carries out the net reaction, reaction (C). Masked copper is introduced in line 6 and the oxygen required for the reaction is introduced in line 7. The required oxygen may be introduced as oxygen in air since it is not necessary to use pure oxygen as the feed for the process. The air is preferably fed in excess amount to ensure complete reaction. No other feed material is required. The other two reactants for formula (C), i.e., ammonium hydroxide and ammonium chloride, are both provided as the reaction products of the following reconditioning process and are fed in line 8. The used etchant solution which is an aqueous solution of tetrammine copper chloride ($Cu(NH_3)_4Cl_2$) is then introduced into the subsequent reconditioning process.

The process within dashed square B is the reconditioning system of the present invention. The used etchant solution is first fed into the first reactor 2 in which reaction (F) is carried out. The tetrammine copper chloride ($Cu(NH_3)_4Cl_2$) in the used etchant solution from etching machine is reacted under agitation with calcium hydroxide ($Ca(OH)_2$) which is fed through line 15 from hydration tank 5 to form a reaction mixture of ammonia gas, an aqueous calcium chloride solution and copper hydroxide precipitate. The use of calcium hydroxide to react with tetrammine copper ion to form the precipitate of copper hydroxide is one of the primary improvements of the present invention. A heater is also incorporated in first reactor 2 to expel the resultant ammonium gas ($NH_3$) from the reaction and enhance the formation of calcium hydroxide ($Ca(OH)_2$). With sufficient agitation and adequate heating, the concentration of copper ion in the reaction mixture of first reactor 2 may be controlled to be below a few ppm. The first reactor 2 also contains a solid-liquid separator in which copper hydroxide precipitate is separated from the liquid reaction mixture containing the product of calcium chloride ($CaCl_2$). The separated copper hydroxide is then moved out the system through line 16. The aqueous calcium chloride solution is then introduced through line 11 and the ammonia gas is vented through line 10, both into the subsequent second reactor 3.

Reactions (G), (J) and (K) are carried out in second reactor 3. According to the mechanism of reaction (J), one fourth of the ammonia gas fed through line 10 from first reactor 2 is reacted with water fed through line 18 and carbon dioxide fed drawn from subsequent decomposing furnace 4 through line 13 to give ammonium hydrogen carbonate ($NH_4HCO_3$). According to the mechanism of reaction (K), three fourths of the ammonia gas introduced through line 10 from first reactor 2 is reacted with water from line 18 to give the reaction product of ammonium hydroxide ($NH_4OH$). The products of reactions (J) and (K), i.e., ammonium hydrogen carbonate ($NH_4HCO_3$) and ammonium hydroxide ($NH_4OH$), are then reacted as formulated in formula (G) with calcium chloride in the reaction product mixture fed through line 11 from first reactor 2 to give the reaction products of calcium carbonate precipitate and an aqueous ammonium chloride solution. The above three reactions may be carried out together within a well agitated environment with sufficient surface contact between the gaseous and liquid reactants. To separate the solid precipitate of calcium carbonate from the liquid reaction mixture, a solid-liquid separator is also installed within the second reactor 3. The separated calcium carbonate is then transported through line 12 into the high temperature decomposition furnace 3. The liquid phase of the reaction product which contains ammonium chloride ($NH_4Cl$, the reaction product of reaction (G)) and ammonium hydroxide ($NH_4OH$, the excess reaction product of reaction (K) which is not consumed in reaction (G)) is then introduced into the etching machine 1 through line 8 as reconditioned etchant solution.

The calcium carbonate from second reactor 3 through line 12 is then sintered in the high temperature decomposition furnace 4 at above 600° C., preferably above 900° C., to give calcium oxide and carbon dioxide (reaction (H)). The resultant carbon oxide exits furnace 4 and is passed by way of line 13 to the second reactor 3 as a reactant. The remaining solid calcium oxide passes in line 14 to hydration tank 5 in which calcium oxide is reacted with water from line 17 to give calcium hydroxide (reaction (I)). Calcium hydroxide is required for the reaction in the first reactor 2 and therefore is passed to the reaction mixture of the first reactor 2 by way of line 15.

To reduce the amount of water required for the reconditioning process of the present invention, the water used for washing the copper hydroxide precipitate from line 16 may be recycled into first reactor 2 as a portion of the feed water. Similarly, water used for washing carbon carbonate precipitate in line 12 may be recycled into line 18 to reduce the cost of feed water. The recycling of water renders waste water treatment unnecessary for the process of the present invention. This adds great advantage to the present process.

The copper is removed as copper hydroxide from the system of the present invention. Copper hydroxide is highly valuable in many fields and is not a waste. For example:

(1) Copper oxide may be used directly as a waterproofing coating.

(2) Copper hydroxide may be converted to copper oxide by sintering to effect the following reaction:

$$Cu(OH)_2 \xrightarrow[\Delta]{} CuO + H_2O$$

The resultant copper oxide is a useful additive for rubber and a pigment for glass or ceramic material.

(3) Copper hydroxide may react with sulfuric acid in the reaction:

$$Cu(OH)_2 + H_2SO_4 + 3H_2O \rightarrow CuSO_4.5H_2O$$

to give copper sulfate which is a effective agricultural chemical or feed additive and is useful for copper plating or copper refining purposes.

(4) Copper can be recovered by reacting copper hydroxide with hydrogen under elevated temperature in the reaction:

$$Cu(OH)_2 + H_2 \rightarrow Cu + H_2O$$

and used in powder form in powder metallurgical industry.

(5) Copper hydroxide may be reacted with hydrogen chloride to give copper chloride which is useful in producing electroplating materials.

$$Cu(OH)_2 + 2HCl \rightarrow CuCl_2 + 2H_2O$$

(6) Copper hydroxide may be reacted with nitric acid to give copper nitrate which is also useful in producing electroplating materials.

$$Cu(OH)_2 + 2HNO_3 \rightarrow Cu(NO_3)_2 + 2H_2O$$

It is readily known from the above explanation that the illustrated system consumes only water and oxygen (in air) and no or only little residual pollutant is resulted. A cheap, clean and effective process for etching copper and reconditioning the etchant solution is thus realized.

It is believed that the invention can be further understood through the illustration of the following example. The following example is offer to aid in understanding of the present invention and is not to be construed as limiting the scope thereof.

EXAMPLE

1. Composition of etchant solution

In an etching process which is carried out as described in "Printed Circuit Handbook", ed. 2, pp 8–12, edited by Clyde F. Coombs. Jr., published by McGraw-Hill Book Company, the etchant solution of the composition:

| | |
|---|---|
| $NH_4OH$ | 6 mole/l |
| $NH_4Cl$ | 5 mole/l |
| $Cu^{++}$ | 2 mole/l |
| $(NH_4)HPO_4$ | 0.01 mole/l |

is used to etch copper and the used etchant solution contains about 2.36 mole/l of copper ion. The used etchant solution is used for testing the reconditioning ability of the present invention.

2. Precipitation of copper content (Reactions (F)(G))

2.36 mole/l of $Ca(OH)_2$ was added slowly into the used etchant solution. Three possible reactions in the used etchant solution were watched:

(1)
$$Cu(NH_3)_4Cl_2 + Ca(OH)_2 \rightarrow Cu(OH)_2 \downarrow + 4NH_3 \uparrow + CaCl_2$$

(2) $$2NH_4Cl + Ca(OH)_2 \rightarrow CaCl_2 + 2NH_4OH$$

(3)
$$2(NH_4)_2HPO_4 + 3Ca(OH)_2 \rightarrow Ca_3(PO_4)_2 \downarrow + 4NH_4OH$$

It was observed that due to high selectivity of $Ca(OH)_2$, only reaction (1) has taken place. A small degree of reaction (2) was observed only when the $Ca(OH)_2$ was added in significant excess. However, even though reaction (2) had actually taken place, the product, i.e., ammonium hydroxide, is one component of the used etchant solution and no new component is obtained. It was thus understood that reaction (F) of the present invention can be realized by adding $Ca(OH)_2$ without incurring undesirable reaction products. After solid-liquid separation, 2.36 mole of $Cu(OH)_2$ was obtained per liter of used etchant solution. 2.36 mole/l of $NH_4HCO_3$ was then added into the liquid phase which contained $CaCl_2$ and 2.36 mole/l of calcium carbonate precipitate was obtained. With the formation of calcium carbonate, suitable amount of $NH_3$ and $CO_2$ was added to keep the pH value below 7. After solid-liquid separation, the liquid phase was reconditioned to the original composition of the etchant solution as listed above. The residual concentration of copper ion in the reconditioned etchant solution was so low that cannot be detected. Even if calcium hydroxide was added in excess, only the amount of calcium chloride and thus the amount of calcium carbonate was increased and the other products or reactants were not affected. In the experimentation, the concentration of copper ion was determined by titration with 0.1M EDTA solution using DOTITE-MX as the indicator. The color of titrated solution turned from deep blue to purple at the end point. The emission of ammonia gas was monitored by recording the rapid increase of pH value. The emergence of copper hydroxide was detected by heating the precipitate at higher than 100° C. in which light blue copper hydroxide was converted into brown-black copper oxide. The calcium oxide was then dissolved and titrated with the same process for titration copper ion.

3. High Temperature Decomposition of Calcium Carbonate (Reaction (H))

Calcium carbonate was calcined under 900° C. and decomposed into calcium oxide and carbon dioxide. The process is well known to persons of ordinary skill in the art.

4. Hydration of Calcium oxide (Reaction (I))

The reaction of calcium oxide with water is a well known exothermic reaction which serve the purpose to accomplish its reaction with copper ion in reaction (F).

It was thus proved by the above example that the present invention has provided a process to satisfactorily recondition used etchant solution for copper with high efficiency and low cost without causing pollution problem.

While only one embodiment of the present invention has been shown and described herein, it will be appreciated that modifications thereof, some of which have been alluded to hereinabove, may still be readily made thereto by those skilled in the art. We, therefore, intend by the appended claims to cover the modifications alluded to herein as well as all other modifications which fall within the true spirit and scope of our invention.

I claim:

1. A process for etching copper with an etchant solution and reconditioning said etchant solution characterized in that it comprises: providing an etching zone, a first reaction zone, a second reaction zone, a decomposition zone, and a hydration zone; said etching zone containing a charge of said etchant solution and a copper material to be etched, said etchant solution being an aqueous solution of ammonium hydroxide and ammonium chloride;

supplying to said etching zone a gaseous feed stream comprising oxygen in excess amount;

allowing said etchant solution to undergo etching reaction with said copper in said etching zone to form an aqueous used etchant solution which contains tetrammine copper chloride;

introducing to said first reaction zone said aqueous used etchant solution and a feed of calcium hydroxide drawn from said hydration zone;

allowing said first aqueous used etchant solution and said calcium hydroxide to react in said first reaction zone to form a first reaction mixture containing ammonia gas, an aqueous calcium chloride solution and copper hydroxide precipitate;

separating said copper hydroxide precipitate from said first reaction mixture;

introducing said ammonia gas and said aqueous calcium chloride solution to said second reaction zone;

supplying to said second reaction zone a first feed water and a feed of carbon dioxide feed drawn from said decomposition zone;

allowing said first feed water, said carbon dioxide, said ammonia and said aqueous calcium chloride solution to undergo reaction at a pH value lower than 7 to form a second reaction mixture of an aqueous solution of ammonium hydroxide and ammonium chloride and calcium carbonate precipitate;

separating said calcium carbonate precipitate from said second reaction mixture and introducing said separated calcium precipitate into said decomposition zone;

sintering said calcium carbonate at a sintering temperature above 600° C. to form gaseous carbon dioxide and calcium oxide;

introducing said gaseous carbon dioxide as said feed of carbon dioxide feed to said second reaction zone;

introducing said calcium oxide to said hydration zone;

supplying a second feed water to said hydration zone;

allowing said calcium oxide to react with said second feed water to form said feed of calcium hydroxide which is introduced to said first reaction zone.

2. The process according to claim 1, in which said sintering temperature is above 900° C.

3. The process according to claim 1, in which said separated copper hydroxide precipitate is subsequently rinsed with rinsing water and said rinsing water is then recycled to said first reaction zone.

4. The process according to claim 1, in which said separated calcium carbonate precipitate is rinsed with rinsing water before it is introduced into said decomposition zone and said rinsing water is then recycled to said second reaction zone.

* * * * *